US007047698B2

(12) United States Patent
Torch

(10) Patent No.: US 7,047,698 B2
(45) Date of Patent: May 23, 2006

(54) EXTERIOR STEP SYSTEM MADE FROM MASONRY UNITS ATTACHED VIA A METAL FRAME

(76) Inventor: Joseph J. Torch, 34 Abbott Rd., Towaco, NJ (US) 07082

( * ) Notice: Subject to any disclaimer, the term of this patent is extended or adjusted under 35 U.S.C. 154(b) by 0 days.

(21) Appl. No.: 10/233,990

(22) Filed: Sep. 4, 2002

(65) Prior Publication Data

US 2004/0040229 A1 Mar. 4, 2004

(51) Int. Cl.
*E04F 11/00* (2006.01)

(52) U.S. Cl. ..... 52/182; 52/184; 52/188; 52/190; 52/191

(58) Field of Classification Search ..... 52/182, 52/190, 191, 188, 8; 182/82, 83, 33, 33.3, 182/35

See application file for complete search history.

(56) References Cited

U.S. PATENT DOCUMENTS

| | | | | | |
|---|---|---|---|---|---|
| 875,113 | A * | 12/1907 | Schachner | 52/190 |
| 1,497,058 | A * | 6/1924 | Barriball | 52/190 |
| 1,861,751 | A * | 6/1932 | Nicols | 52/189 |
| 1,879,996 | A * | 9/1932 | Sherwood | 52/189 |
| 1,963,866 | A * | 6/1934 | Peterson | 52/190 |
| 2,153,017 | A * | 4/1939 | Hensderson | 52/189 |
| 2,155,908 | A * | 4/1939 | Samonds | 249/14 |
| 2,171,951 | A * | 9/1939 | Rosenberger | 52/189 |
| 2,374,905 | A * | 5/1945 | Wale | 52/189 |
| 2,697,931 | A * | 12/1954 | Schill | 52/189 |
| 2,722,823 | A * | 11/1955 | Summers | 52/189 |
| 2,939,309 | A * | 6/1960 | Sitton | 52/189 |
| 3,025,639 | A * | 3/1962 | Lemieux | 52/189 |
| 3,706,170 | A * | 12/1972 | Argraves et al. | 52/189 |
| 3,768,215 | A * | 10/1973 | Raymond et al. | 52/9 |
| 4,244,154 | A * | 1/1981 | Weaver | 52/185 |
| 4,250,672 | A * | 2/1981 | Seegers et al. | 52/182 |
| 4,406,347 | A * | 9/1983 | Stathopoulos | 182/1 |
| 4,438,608 | A * | 3/1984 | Hamm | 52/187 |
| 4,802,320 | A | 2/1989 | Forsberg | |
| 4,875,315 | A * | 10/1989 | Champagne | 52/189 |
| 4,899,504 | A * | 2/1990 | Hirschhorn | 52/182 |
| 4,959,935 | A * | 10/1990 | Stob | 52/183 |
| 5,014,475 | A * | 5/1991 | Anderson et al. | 52/191 |
| 5,017,049 | A | 5/1991 | Sievert | |
| 5,050,353 | A * | 9/1991 | Rogers et al. | 52/8 |
| 5,479,746 | A * | 1/1996 | Mannonen | 52/182 |
| 5,921,031 | A * | 7/1999 | Williams | 52/8 |
| 6,088,977 | A * | 7/2000 | Lawrence | 52/182 |
| 6,176,049 | B1 * | 1/2001 | Crant et al. | 52/188 |
| 6,295,772 | B1 * | 10/2001 | Whitson | 52/182 |
| 6,397,529 | B1 * | 6/2002 | Grenier | 52/182 |
| 6,634,145 | B1 * | 10/2003 | Dolph | 52/189 |

* cited by examiner

*Primary Examiner*—Daniel P. Stodola
*Assistant Examiner*—Nahid Amiri
(74) *Attorney, Agent, or Firm*—Watov & Kipnes, P.C.

(57) ABSTRACT

A step system made up of masonry panels of various sizes pre-formed to resemble natural stone or brick on the outside. These panels have bolts or other securing devices embedded in them at precise locations at the time of their manufacture. These securing devises allow them to be attached together to form the sides and front of a set of steps. They are attached via a metal frame that is also of differing sizes and made with holes at precise locations to accept the bolts of the masonry pieces. When assembled, as directed, the structure has areas where large slabs of natural stone treads can be rested and attached at differing distances and heights from the ground forming a set of steps.

14 Claims, 6 Drawing Sheets

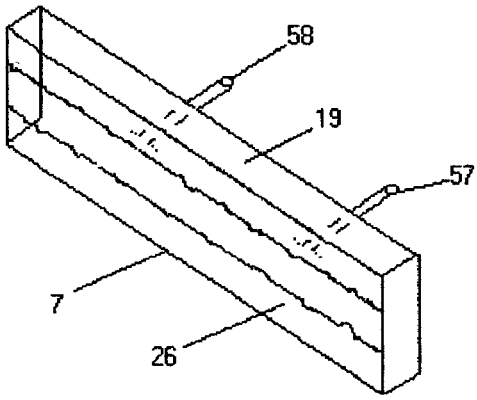
FIGURE 3
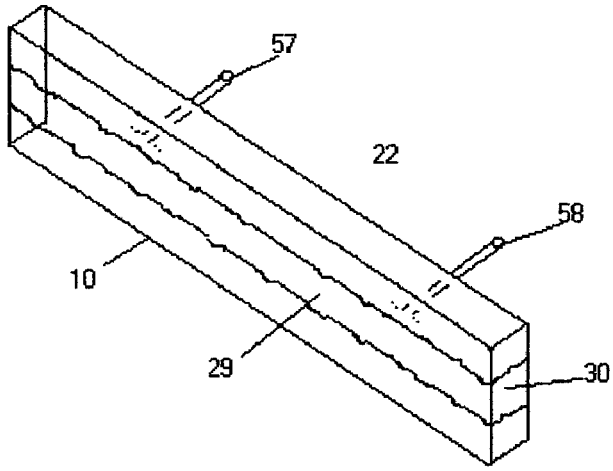

EXTERIOR STEP SYSTEM MADE FROM MASONRY UNITS ATTACHED VIA A METAL FRAME

BACKGROUND OF THE INVENTION

Staircases or a set of steps are used to walk from one elevation to another elevation. While steps have been around for so long that no one can say for sure about the first set of steps, one can only imagine that the first set of steps were probable stones stacked upon one another. As time went on, ways to attach the stones more permanently to one another were developed. Even before the invention of modern cement, evidence exists that ancient civilizations used certain materials to "mortar" stones together to form a set of steps. Even before blades were used to cut trees into lumber, logs were shaped into flat steps and attached to make a staircase. Not long after iron and steel were developed, they too were soon used to fabricate a set of steps.

Whatever the method used by the ancient civilizations, the method of constructing a staircase was always the same. They would gather the raw materials they were going to use and take them to the site where they were going to use them then they would fabricate the staircase using one piece at a time. This method is the most commonly used method still to this day. It usually involves bringing boards, cutting them and nailing them together or using masonry blocks, or stone, or bricks and mortaring them together. Another commonly used method today involves forming a staircase out of wood or like material and pouring concrete to take the shape of a staircase.

While a set of steps fabricated in these ways can be very beautiful and elaborate, they can also be very expensive. To make a set of steps in stone or brick is beyond the know-how of the typical home-owner and a professional mason has to be hired. Also because steps done in this fashion are stone or bricks cemented together into one large piece, these types set of steps has to be placed on a footing. If a footing were not used, any settling or shifting would cause this one large piece to crack.

To custom build a set of steps one piece at a time is not the only way to build a set of steps however, "prefabricated" steps are known in the art. "Prefabricated" staircases are built in a factory or some other location and then taken to a site where they are typically attached to the upper and lower elevations. Interior wooden staircases are the most common of these and are widely used today. Exterior staircases made of pressure treated lumber are also used. Prefabricated steel steps are commonly used for fire escapes and the like. U.S. Pat. No. 4,438,608, U.S. Pat. No. 4,802,320, and U.S. Pat. No. 4,899,504 are types of these. While prefabricated interior staircase can be very decorative and elaborate, most types of these materials can't stand up to the elements when used in the exterior.

One type of prefabricated steps that can stand up to the elements is a prefabricated concrete unit. The problem with this is that they are make of solid concrete and have to be set in place by a mechanical lift of some sort. Making it impractical for installation in some locations.

One way to solve the problems that large and heavy prefabricated units present is by developing pre-made parts specifically designed for use as a stair or staircase. Most people can assemble stair parts like these without costly professional help. While precut parts used to make a set of steps can be purchased at any local home building materials store, most are out of lumber or metal not out of masonry that can be long lasting when used in the exterior.

There are methods using some sort of block that is stacked one upon another, known in the art. Some have means of interlocking and can even be assembled without "mortaring" the blocks together. In U.S. Pat. No. 6,295,772, U.S. Pat. No. 6,176,049 and U.S. Pat. No. 5,479,746 are examples of types of masonry block that are used almost exclusively for making steps.

Recently steps have been make using split faced masonry block, U.S. Pat. No. 4,802,320 and U.S. Pat. No. 5,017,049 are examples of these blocks and can be glued together with a masonry adhesive to form a set of steps. This method allows the staircase to "give", thereby preventing cracking. The appearance of this type of staircase is limited because of the way these blocks are manufactured. Also, any method used to build a set of steps out of blocks stacked one upon another requires the use of many blocks, not only on the outside and front face but also the totality of the inside from the ground up to the top and from side to side.

It has been known for some time in the art to build masonry steps for outdoor use using materials other than stacked blocks. U.S. Pat. No. 5,014,475, U.S. Pat. No. 4,959,935, U.S. Pat. No. 4,406,347, U.S. Pat. No. 4,250,672, and U.S. Pat. No. 4,244,154 all have masonry pieces that don't require the total area under the step treads to be built up. All these methods use a stringer type design for the risers. The trouble with a stringer design is a different sized stringer would be used for staircases with different numbers of steps. This would present a problem to supply stores that would have to carry inventories for one step units, different stringers for two step units, and so on.

U.S. Pat. No. 1,879,996, U.S. Pat. No. 2,697,931, U.S. Pat. No. 2,722,823, U.S. Pat. No. 3,025,639, U.S. Pat. No. 3,706,170 all have solid side pieces not stringers, that serve as risers. While these staircase systems also don't require the total area under the step tread to be built up, they have the same problem in that supply houses would have to carry different side pieces for each set of differing numbers of steps. These large inventories are very costly and inconvenient.

U.S. Pat. No. 2,374,905 has masonry pieces stacked upon one another not solid side pieces. But this system talks of poured concrete key-ways, thereby presenting the same problem of cracking that any solid masonry staircase would present.

It would therefore be a significant advance of the art to provide a staircase or set of steps made out of long lasting masonry pieces which could take on the appearance of natural stone or brick. And which could be easily assembled using just nuts and bolts, without having to pour footings or "cement" these pieces together. It would also be an advance in the art if these masonry pieces could be easy to handle and assembled in such a way as to use as few pieces as possible in the construction of the staircase. It would be a further advance in the art to develop a system to produce exterior staircases that could be used to build steps of differing numbers of steps and steps of differing widths using interchangeable parts. And at the same time being able to inventory only small amounts of system pieces to do this.

BRIEF SUMMARY OF THE INVENTION

The present invention is generally directed to an exterior staircase or set of steps made from pre-manufactured masonry and steel pieces. These pieces can be easily assembled to produce a long lasting set of steps.

In particular one object of the invention is to use pieces that are light enough to be handled by hand and can be connected together on site.

Another object is to use decorative, preformed in molds, manufactured pieces. These pieces would be pre-sized and fined to go together in such a way as to form a set of steps.

Another object of the present invention is to put these pieces together so they are not cemented together.

Another object is to use specific pieces for specific parts of the step. I.e. the sides of a 3-step unit will have 3 courses for each side. While the pieces that form these courses are interchangeable from left side to right side, they are different sizes for each different step. The bottom course being a masonry piece or multiple pieces that are longer than the course above it and the one above that being shorter still.

Another object is to use side pieces that can be used on either the right side or the left side risers, and use the same front pieces for the first step, second step, third step and so on. The front pieces are interchangeable with other front pieces of the same width step, but not interchangeable with other steps of different widths or any side pieces.

Another object is to use different front pieces (longer or shorter), attached to the same side pieces, in order to construct different widths of steps.

Another object is to use masonry pieces for the bottom step that are a different height than the ones used for the remaining steps.

Another object is to use masonry pieces that are formed with embedded bolts or other securing devices, so they can be attached.

Another object of the invention is to use a rigid frame that can act as the securing device for the masonry units. And to have this frame constructed in such a way as to allow for all courses of the side risers to be stacked one upon another and connected to each other, while at the same time allowing multiple pieces to be used for each course, if necessary.

Also, another object of the invention is to have this frame able to connect the right side risers to he left side risers and both sides to the front riser pieces.

Another object is to allow for limestone or other natural stone treads to be placed and secured into the unit and act as the actual step.

BRIEF DESCRIPTION OF THE SEVERAL VIEWS OF THE DRAWINGS

FIG. 3 is a perspective view showing a left front riser and a right front riser of a step unit.

FIG. 4 is a perspective view showing a mold that a side riser piece is formed in.

DETAILED DESCRIPTION OF THE INVENTION

Figure 1:
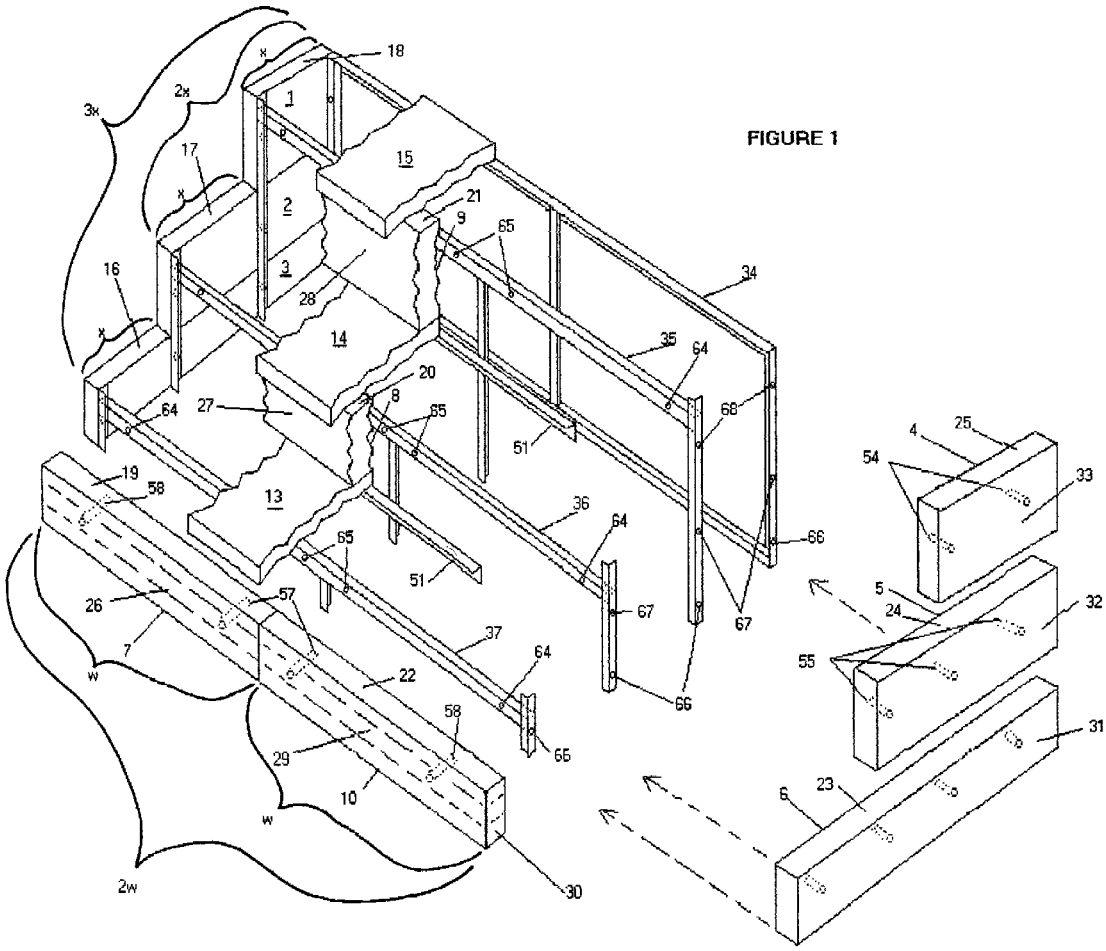
FIG. 1 is a perspective view of a three-step unit of the present invention showing the masonry side and front pieces as well as the treads.

In FIG. 1, masonry pieces are different sizes. Top left riser 1 rests on top of left middle riser 2, which rests on the top of left bottom riser 3. The bottom of left bottom riser 3 rests on the ground. Riser 3 is different height than riser 2 & riser 1. According to most building codes, typically a step is 7½"–8" high. From the ground, the top of the first step should be 7½". The stone slabs are commonly used in other step applications and are typically 2" in thickness. The stone slab or tread 13 rests on top of left bottom riser 3 and right bottom riser 4. Since the slap is already 2", the height of the bottom pieces 3 and 6 should be 5½" to bring the height of the bottom step to 7½". The second stone slab or tread 14 is the second step. The second stone slab 14 rests on the top of left middle riser 2 and right middle riser 5. The height distance from stone slabs 13 to the stone slab 14 should be 7½". Side riser 2 rests on top of side 3, but the bottom of side 2 is the thickness of stone slab 13 or 2" lower than the top of the first stone slab 13. Therefore, to get the 7½" step height the height of side 2 if 7½":. The height from stone slab 14 to stone slab 13 is 7½". Side 1 rests on top of side 2. The bottom of side 1 is 2" lower than the bottom of the second step. Therefore, the height of the side 1 is 7½". With the stone slabs resting on the tops of the side pieces and the next ascending side pieces resting on the side piece below it, any side piece after the first step will by 7½" high. This will follow from step 2 to step 3 to step 4 and beyond. The bottom sidepiece will always be 5½" in height.

Top left riser 1 is a certain width, in this instance x. The width x of side riser 2 is twice that of the side riser 1 and that is 2x. The width of side riser 3 is three times the width of side riser 1 and that is 3x. Increasing numbers of steps have lengths that have similar increasing multiples of side riser 1.

Figure 2:
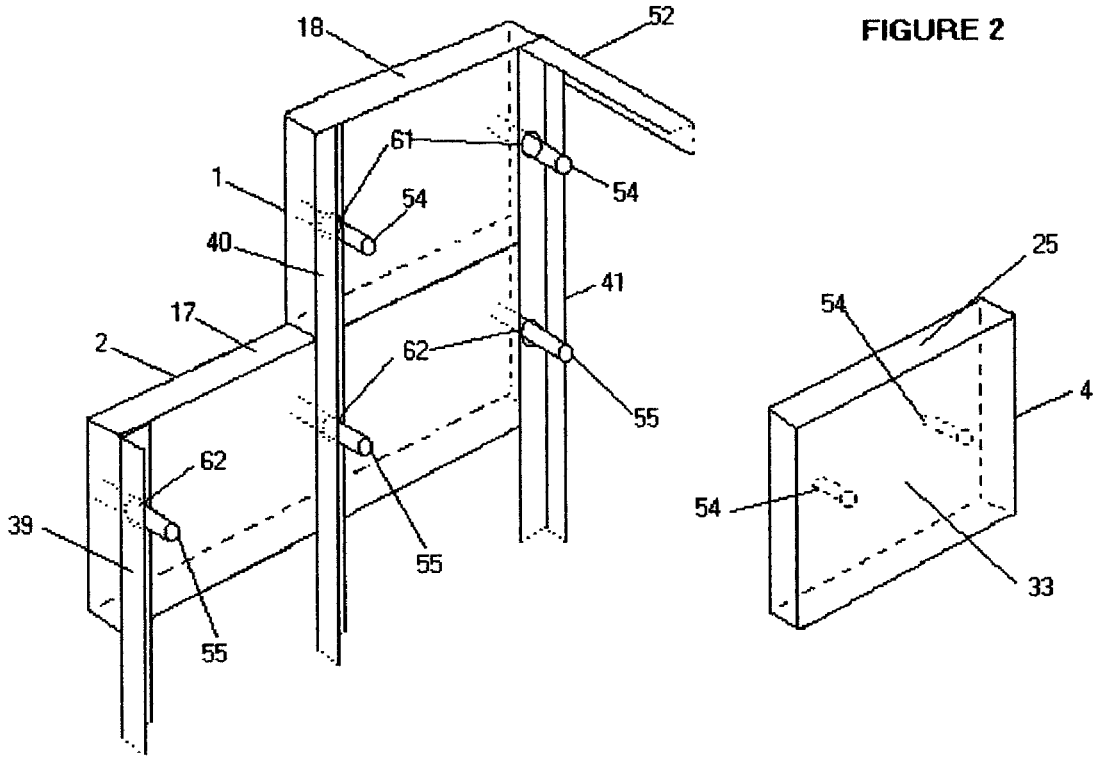
FIG. 2 is a perspective view showing a top left riser side and a top right riser side of a step unit.

FIG. 2 shows both left top riser 1 and right top riser 4. Both pieces have six sides and are the same dimensions. The bolts 54 are in the middle, from top to bottom, of side riser 1. Decorative face 33 is the outside side of riser 1 and used on the outside of the steps. Top face 18 is the top of riser 1. When left riser 1 is flipped end for end it is now in the same configuration as right riser 4 with the decorative face 33 being on the outside. The top face 18 is in the bottom side position of right riser 4. The bolts 54 are still in the middle from top to bottom of riser 4. All side riser pieces, while having different dimensions, are configured the same and therefore, interchangeable in the same position from left side to right side.

In FIG. 1, front riser 8 rests between tread 13 and 14 and on top of tread 13. Since treads are typically 2", the distance between top of tread 13 and bottom of tread 14 is 5½". Front riser 8 as well as all other front risers are the same height dimension, typically 5½". The front risers could be one long piece but long narrow pieces of concrete can easily break during transport. In FIG. 1, front risers are most typically two pieces, left front risers 7, 8, and 9 shown specifically in FIG. 1 and right front risers 10, 11, and 12 shown specifically in FIG. 6. Because these pieces have bolts that are placed in the middle of the pieces and equal distance from side to side, they can be flipped end for end and are interchangeable from left side to right side, the same way that side riser-pieces are interchangeable in FIG. 2. Whether it is the first, second, third or any other step, the length of the front riser-piece determines the width of the step from side to side. In FIG. 1, the length of the front riser 7 is w. All front risers of the same step unit have risers of equal length. By making the length w of riser 7 longer, the step unit's width, from side to side, becomes wider. In FIG. 1, the top faces 19 and 22 of the front bottom risers 7 and 10 is at the same height elevation as the top face 16 of left side riser 3 and the top face 23 of the right side riser 6. The tops faces of the risers 16, 19, 22 and 23 provide an area where slab 13 can rest and be affixed with glue to the risers. The bearing weight is transferred, at this point, from the treads to the ground.

The top faces 19 and 22 of the front risers 7 and 10 allow for the stone tread 13 to rest on top and the bearing weight is transferred to the ground for the first step. In FIG. 1, on the next step the top face 20 of the front riser 8 allow for the stone tread 14 to rest on top of riser 8. This piece then rests on tread 13 below it, which rests on angle bracket 51, which is attached to upright center bracket 48 (see FIG. 5) which transfers bearing weight to the ground. All bearing weight from the front of the tread is Transferred to the ground in this manner on all subsequent steps.

Figure 4:
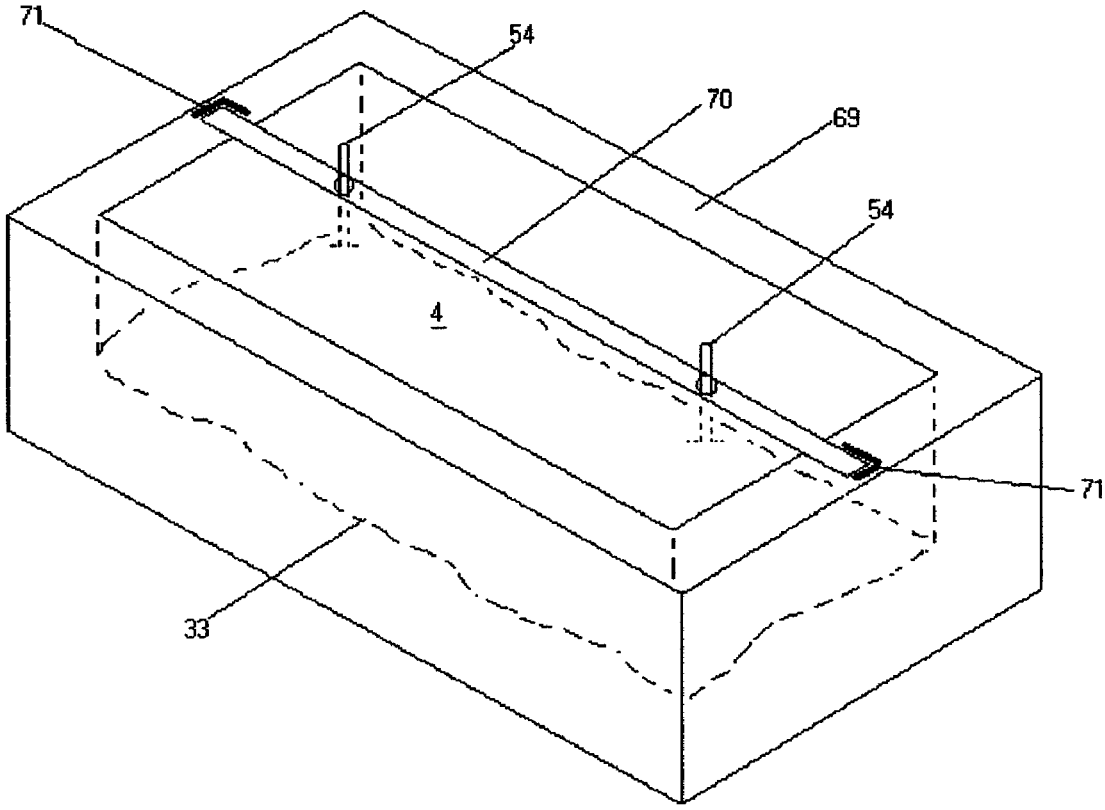

All the side pieces and the front pieces have decorative front faces. In FIG. 2, the front face 33 is the outer face of the masonry side riser 4. In FIG. 3, front riser 10 is decorative on the front face 29 and around the corner at side face 30. Most decorative masonry blocks are split faced as in (U.S. Pat. No. 4,802,320) or in (U.S. Pat. No. 5,017,049). These blocks are typically made with dry packed concrete. In FIG. 2, because these masonry pieces have embedded bolts 54 & 55, they are typically made in molds with wet concrete. Because they are made in wet concrete it allows for greater definition of the decorative face. FIG. 4 shows typical mold used to produce masonry side and front pieces, in this case it is a mold for top side riser 4. Mold 69 is typically rubber or like material, which can be shaped to produce different decorative front faces. The mold allows for five faces of the masonry piece to be formed, with the sixth face formed when concrete is poured into the top of the mold. Decorative face 33 is on bottom of mold. Masonry riser 4 is shown with embedded bolts 54. These bolts must be embedded at enough of a depth in concrete as to provide for sufficient holding power but must not extend through masonry piece to front face. In FIG. 4, the bolts must also be at precise locations in the wet concrete. The bolts are typically held at precise locations in the wet concrete mold by a bracket 67 and bracket stops 68 which corresponds to the locations of the holes in the steel frame. The bolts 54 must extend out of concrete enough distance to be able to go through pre-drilled holes in metal frame.

Figure 5:
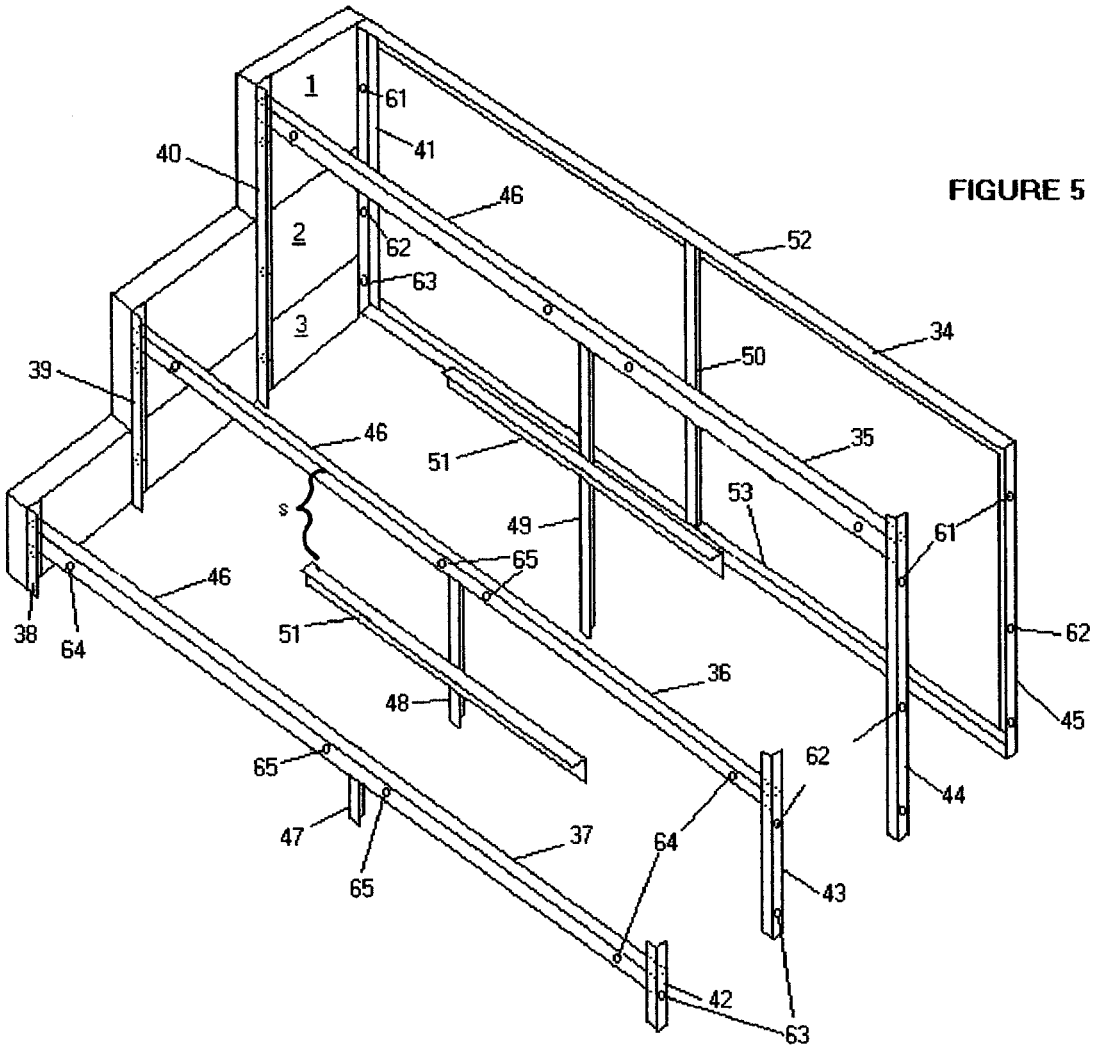
FIG. 5 is a perspective view showing the metal frame parts of a three-step unit.

FIG. 5 shows steel frame. Steel is typically used but any metal, aluminum or rigid material will do. Metal must be primed and painted because metal is exposed to the air. Frames 34, 35, 36, and 37 can be of any rigid material as to allow for distance from side riser pieces 1, 2, and 3 to side riser pieces 4, 5, and 6 to be held constant. As with the masonry pieces, the steel frames are different sizes from different locations. In FIG. 5, the shapes of the front frames are mostly the same, consisting of a cross bracket, a left upright bracket, a right upright bracket, and a center upright bracket. For frame 36, the cross bracket is 46, the left upright bracket is 43, the right upright bracket is 48. Center upright bracket 48 also has an angle bracket 51 attached at a 90 degree angle. Frames are the same length for all steps therefore, the cross brackets of all the steps will be the same length. For the next step, the left upright bracket 40, the right upright bracket 44, and the center upright bracket 49 are longer in length. As the steps increase, so does the length of the upright brackets. Angle bracket 51 is attached at center upright bracket 49 at a location where it will support the back of the tread. This distance s, down from the top of the cross bracket 46 will be the same on all subsequent steps, and all subsequent cross brackets.

Figure 6:
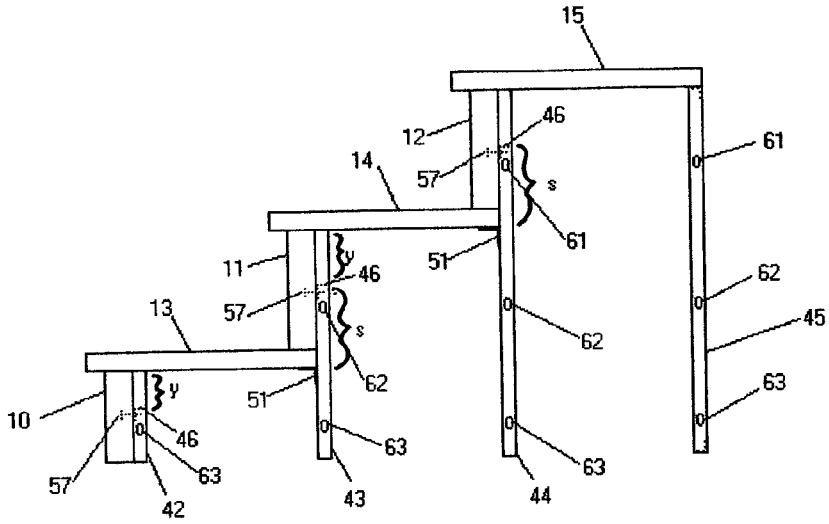
FIG. 6 is a side plane view showing the metal frames, front riser pieces, and stone treads of a three-step unit.

The frame that goes all he way to the back of the step is different from the other frames. This frame 34 includes a top cross bracket 52, a bottom cross bracket 53, a left upright bracket 41, a right upright bracket 45, and a center upright bracket 50. FIG. 5 shows back frame always goes to back of step. The back frame pieces could have pre-drilled holes that would allow four steps to be attached to house or other structure. The upright pieces of the frame are able to connect the masonry piece below to any masonry piece above it. In order for the frames to be able to connect the masonry pieces together, they must have holes to let the bolts that are embedded in the masonry pieces, pass through. In FIG. 2 the bolt holes 61 and 62 are at precise locations in the upright frame bracket 40 that corresponds to the location of bolts in masonry riser pieces. These bolts 54 and 55 can pass thru the bolt holes 61 and 62 and can be secured with nuts or other means. In FIG. 5, left upright bracket 39 connects masonry riser 3 to masonry riser 2. Upright bracket 40 connects masonry riser 3 to masonry riser 2 and masonry riser 1. In FIG. 6, this cross bracket 46 is attached to upright bracket 43 at a point below the top of upright bracket 43. The bolt 57 embedded in front riser 10 is at a distance y, which is the midpoint of the height of the masonry front riser 10. Therefore, the midpoint of cross bracket 46 is at a distance y down from the top of upright bracket 43. All front cross brackets are connected to both left and right upright brackets at this distance y from the top of their corresponding brackets. This follows for all steps.

In FIG. 1, the stone treads 13, 14, and 15 may be of natural stone or of a manufactured masonry material. The treads must be of the same thickness so they can be interchangeable and this thickness must be constant. In FIG. 6, the height on front risers 10, 11, and 12 are constant, most generally at 5½". The distance from cross bracket 46 to the steel angle bracket 51 is constant at s. The height of stone tread 13 must be a constant thickness in order to fit under front masonry risers and on top of angle bracket 51. FIG. 1 shows width of stone tread 13. This width corresponds to the length of the top riser face 16 that it rests on, plus the width of the top face 19 of the front rise 7 plus an overhang. A one-inch overhang is most generally used. The exposed top faces of the risers 2 and 3 are all the same. This distance is x. The front riser top edges are all the same thickness. Therefore, the width of the treads 13, 14, and 15 are all the same. The lengths of the stone treads are different for each step units of different widths but are the same for each tread within a given step unit. In FIG. 1 the length of the stone tread 13 corresponds to the length w of the front riser piece 7 plus the length w of the front riser piece 10. This length of the tread 13 is 2w. A front riser piece with a longer length w would make for a corresponding longer stone tread 2w.

While the above is the preferred embodiment of the invention, many modifications may become apparent to those skilled in the art and these should be considered within the scope and spirit of the invention as defined by the following claims.

I claim:

1. A set of steps or a staircase comprising:

(a) a number of masonry side pieces stacked one upon another forming the left side risers of the steps or staircase;

(b) a number of masonry side pieces stacked one upon another forming the right side risers of the steps or staircase;

(c) a number of masonry front pieces used to form the front part of the risers;

(d) a number of brackets defining a metal frame that connect the masonry left and right side pieces and the front riser pieces, said metal frame comprises a left upright bracket, a right upright bracket, and a front cross bracket, wherein the left upright bracket extends from the bottom course of the left side risers to the top course of the left side risers and attaches all left masonry side riser pieces, and wherein the right upright bracket extends from the bottom course of the right side risers to the top course of the right side risers and attaches all right masonry side riser pieces, and wherein the front cross bracket extends from the left side of the steps to the right side of the steps and attached to the front masonry riser pieces;

(e) a number of masonry slabs that form the actual step tread and rest on top of said risers and are attached thereto.

2. A set of steps or a staircase according to claim 1, wherein masonry side pieces are stacked in courses corresponding to each step, the bottom course being the longest and the length of the course, from front to back, are shorter as the steps go up.

3. A set of steps or a staircase according to claim 2, wherein courses comprises a plurality of masonry pieces.

4. A set of steps or a staircase according to claim 1, wherein said masonry side pieces are stacked in courses and the bottom course is of a different height dimension that the higher up courses.

5. A set of steps or a staircase according to claim 1, wherein said masonry side pieces are interchangeable from the left side of steps to right side of steps and vise versa.

6. A set of steps or a staircase according to claim 1, wherein said masonry front pieces are positioned in courses corresponding to each step and each said masonry front pieces is the same height and length dimension as all others used in the same staircase.

7. A set of steps or a staircase according to claim 1, wherein tops of left riser, right riser, and front riser of each course are at the same elevation and provide a level area where slab can be rested upon and affixed.

8. A set of steps, or a staircase according to claim 1, wherein said masonry side pieces and front risers are formed in decorative molds.

9. A set of steps, or a staircase according to claim 1, wherein said masonry side pieces and front risers are formed using embedded fastening devices.

10. A set if steps or a staircase according to claim 1, wherein said metal frame has pre-drilled holes.

11. A set of steps, or a staircase according to claim 1, wherein said frame has a center upright piece that extends down from the front cross bracket to the ground and said center upright piece has an attached flange where said masonry slabs rest and bearing weight from said slab is shifted to the ground.

12. A set of steps, or a staircase according to claim 1, wherein said frame is steel.

13. A set of steps, or a staircase according to claim 1, wherein the masonry slabs are of uniform thickness.

14. A set of steps, or a staircase according to claim 1, wherein front riser pieces rest on the top of the masonry tread of the step below.

* * * * *